US005954519A

United States Patent [19]

Hsiao

[11] Patent Number: 5,954,519

[45] Date of Patent: Sep. 21, 1999

[54] MOUNTING POSITION ADJUSTABLE MINI WALL LAMP

[76] Inventor: Hsu-Ting Hsiao, No. 7, Lane 27, Ching Hwa Street, Pei Kwang Chen, Yunlin Hsien, Taiwan

[21] Appl. No.: 09/136,062

[22] Filed: Aug. 19, 1998

[51] Int. Cl.[6] ..... H01R 39/00

[52] U.S. Cl. ..... 439/21

[58] Field of Search ..... 439/18, 20, 21, 439/22, 27, 640, 655

[56] References Cited

U.S. PATENT DOCUMENTS 5,775,921 4/1996 Chou ..... 439/21

*Primary Examiner*—Steven L. Stephan
*Assistant Examiner*—Javaid Nasri
*Attorney, Agent, or Firm*—Dougherty & Troxell

[57] ABSTRACT

A mounting position adjustable mini wall lamp includes a fixed member fixedly mounted inside a housing to hold a first annular contact and a second annular contact within the first annular contact, a central terminal and a side terminal controlled by a switch to transmit power supply from the first and second annular contacts to the lamp bulb vertically installed in the housing, a rotary cap rotatably horizontally mounted in a circular hole on the housing, and a pair of metal contacts mounted in the rotary cap and respectively maintained in contact with the first and second annular contacts for connection to an electric socket to obtain power supply from it.

5 Claims, 6 Drawing Sheets

MOUNTING POSITION ADJUSTABLE MINI WALL LAMP

BACKGROUND AND SUMMARY OF THE INVENTION

The present invention relates to a mini wall lamp, and more particularly to a mounting position adjustable mini wall lamp which has a rotary plug for obtaining power supply from an electric socket.

FIG. 1 shows a mounting position adjustable mini wall lamp according to the prior art. This structure of mini wall lamp comprises a housing formed of two half shells, a rotary plug coupled to one half shell, the rotary plug comprising two metal blades for connection to an electric socket and two annular metal contacts concentrically provided on the inside, a first metal contact plate having an extension rod extended out of the half shell and retained in contact with one annular contact, a second metal contact plate having an extension rod extended out of the half shell and retained in contact with one annular contact, a third metal contact plate, and a switch driven to force the third metal contact plate into contact with the second metal contact plate, causing the circuit to be closed. This structure of mini wall lamp is still not satisfactory in function. Because the extension rods are thin and long, they tend to be deformed or damaged, causing a high contact resistance to be produced.

The present invention has been accomplished to provide a mounting position adjustable mini wall lamp which eliminates the aforesaid problem. According to one aspect of the present invention, the mini wall lamp comprises a fixed member fixedly mounted inside a housing to hold a first annular contact and a second annular contact within the first annular contact, a central terminal and a side terminal controlled by a switch to transmit power supply from the first and second annular contacts to the lamp bulb vertically installed in the housing, a rotary cap rotatably horizontally mounted in a circular hole on the housing, and a pair of metal contacts mounted in the rotary cap and respectively maintained in contact with the first and second annular contacts for connection to an electric socket to obtain power supply from it. According to another aspect of the present invention, the annular contacts each have a peripheral groove for receiving the endpiece of the corresponding metal blade.

DETAILED DESCRIPTION OF THE PREFERRED EMBODIMENT

Figure 1:
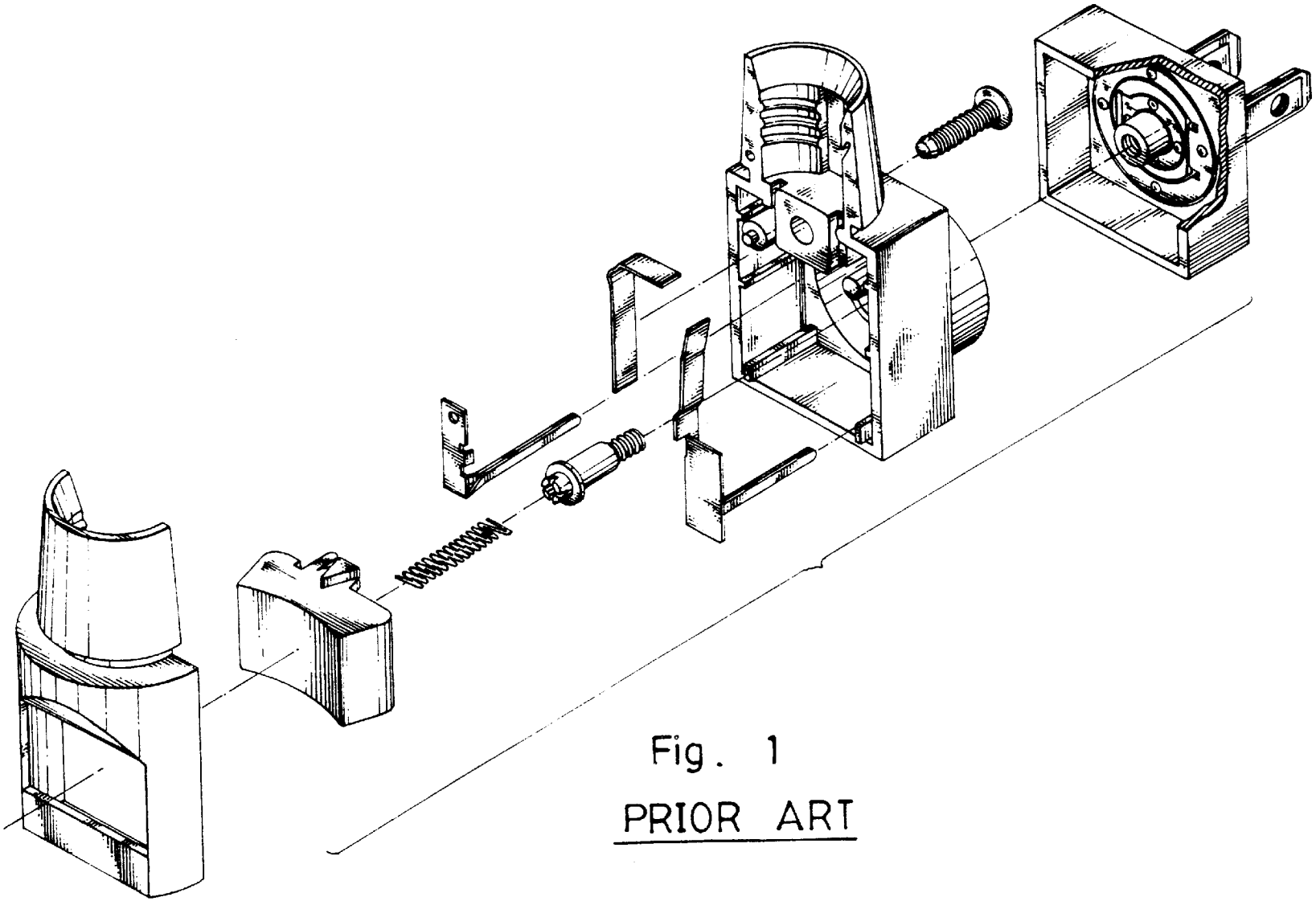
Fig. 1 PRIOR ART
FIG. 1 is an exploded view of a mounting position adjustable mini wall lamp according to the prior art.
Figure 2:
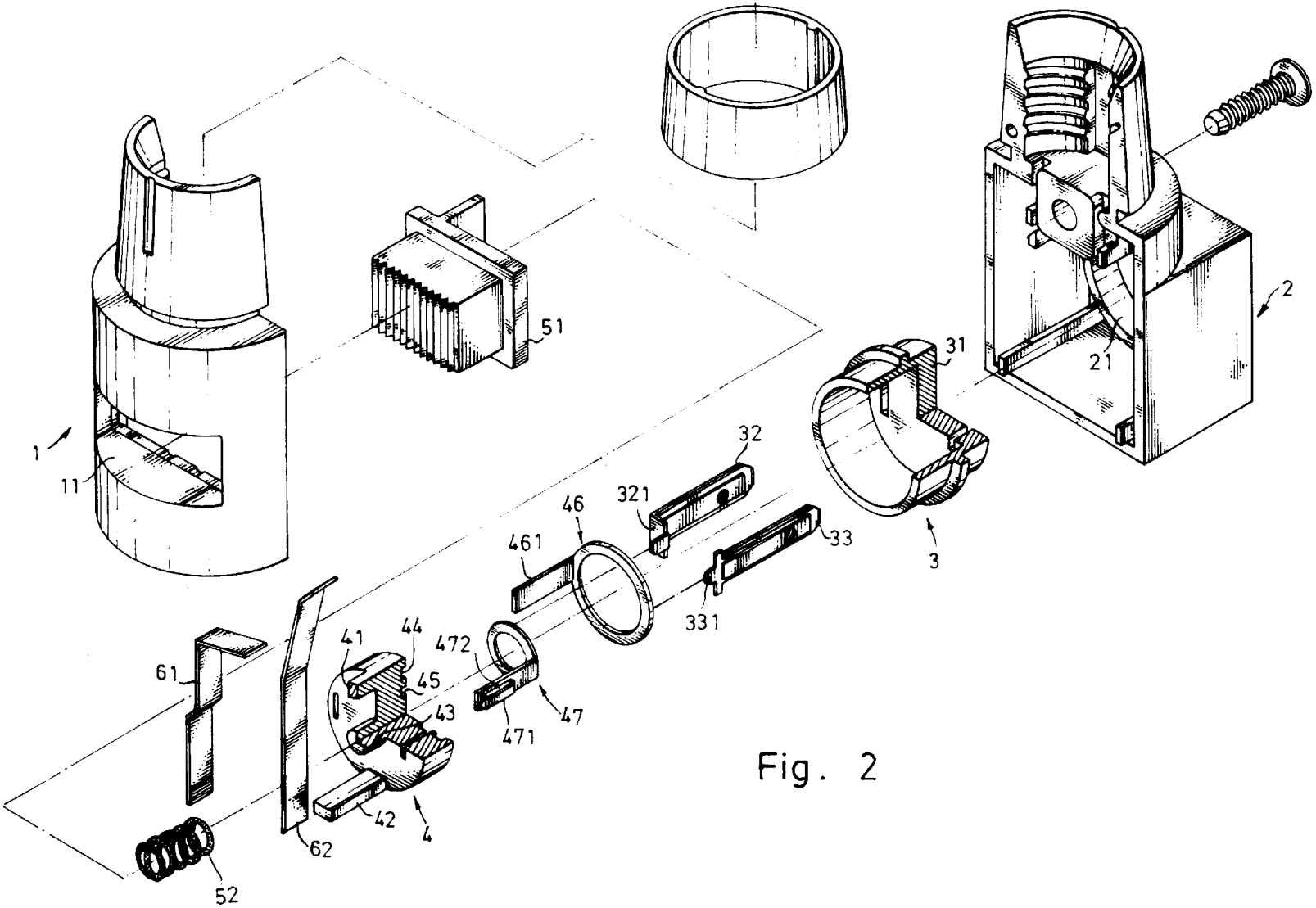
FIG. 2 is an exploded view of a mounting position adjustable mini wall lamp according to the present invention.
Figure 3:
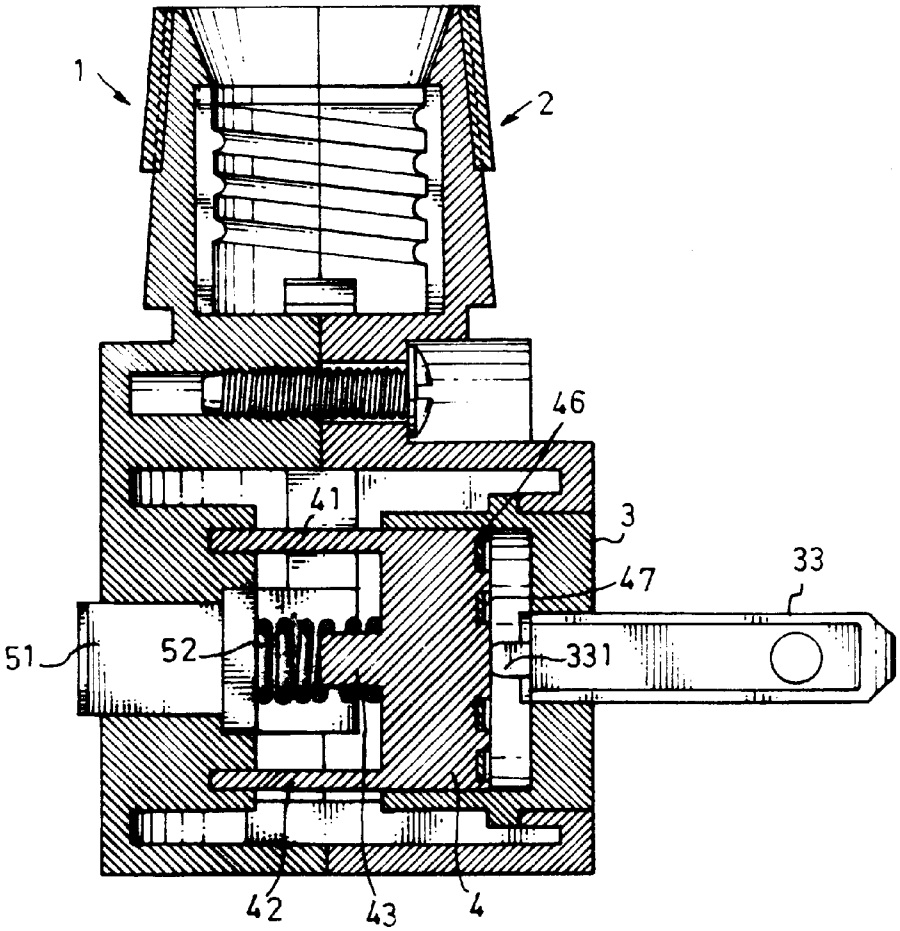
FIG. 3 is a longitudinal view in section of the mini wall la p according to the present invention.
Figure 4:
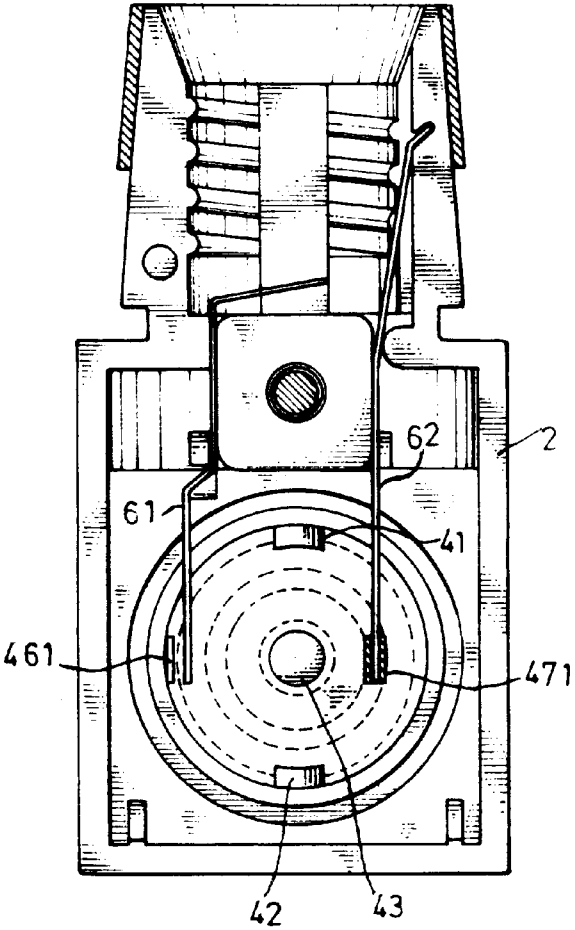
FIG. 4 is a transverse view in section of the mini wall lamp according to the present invention.
Figure 5:
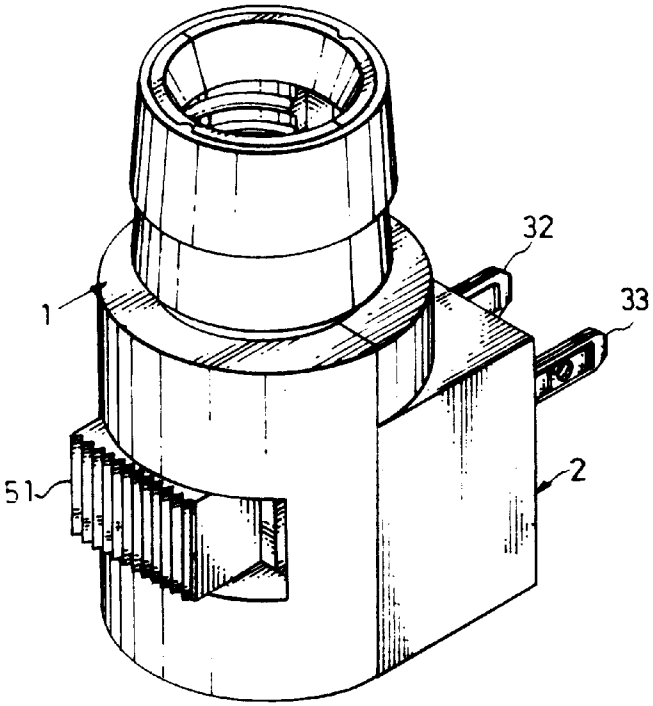
FIG. 5 is a perspective view of the mini wall lamp according to the present invention.

Referring to FIGS. from 2 through 5, the mini wall lamp comprises a housing formed of two half shells 1, 2. One half shell, namely, the first half shell 1 is a stepped, semi-circular member having a transverse hole 11 at the lower part thereof, which receives a switch 51. The other half shell, namely, the second half shell 2 has a semi-circular upper section and a hollow rectangular lower section. A circular through hole 21 is provided at the hollow rectangular lower section of the second half shell 2. A rotary cap 3 is mounted in the circular through hole 21 to hold a pair of metal blades 32, 33. The metal blades 32, 33 extend out of the second half shell 2 for insertion into an electric socket to obtain power supply from it. One metal blade, namely, the first metal blade 33 has a straight endpiece 331. The other metal blade, namely, the second metal blade 32 has an angled endpiece 321. The axial length of the endpiece 321 or 331 is within about 2~5 mm. A circular fixed member 4 is mounted in the rotary cap 3. The circular fixed member 4 comprises two mounting rods 41, 42 bilaterally axially extended from the back side wall thereof and respectively fastened to respective plug holes in the first half shell 1, a stub round rod 43 raised from the center of the back side wall to hold a compression spring 52, an inner annular groove 45 and an outer annular groove 44 concentrically provided at the front side wall thereof. The compression spring 52 has one end connected to the stub round rod 43 of the fixed member 4, and an opposite end connected to the switch 51. A first annular contact 46 and a second annular contact 47 are respectively mounted in the inner annular groove 45 and the outer annular groove 44 at the front side wall of the fixed member 4, and retained in contact with the endpiece 331 of the first metal blade 33 and the endpiece 321 of the second metal blade 32 respectively. The second annular contact 47 has a contact strip 471 perpendicularly raised from the periphery and inserted through an axial through hole on the fixed member 4. The first annular contact 46 has a contact strip 461 perpendicularly raised from the periphery and inserted through an axial through hole on the fixed member 4. The contact strip 471 of the second annular contact 47 has a through hole 472. Two terminals, namely, the central termianl 61 and the side terminal 62 are fixedly mounted inside the shells 1, 2 for contact the tip contact and the ring contact of the lamp bulb installed in the internally threaded upper sections of the shells 1, 2. The central terminal 61 is spaced from the contact strip 461 of the first annular contact 46 at a distance. The side terminal 62 is fastened to the through hole 472 at the second annular contact 47. Therefore, the side terminal 62 and the contact strip 461 of the first annular contact 46 are constantly connected. The switch 51 is forced into close contact with the inside wall of the first half shell 1 by the compression spring 52.

Figure 6:
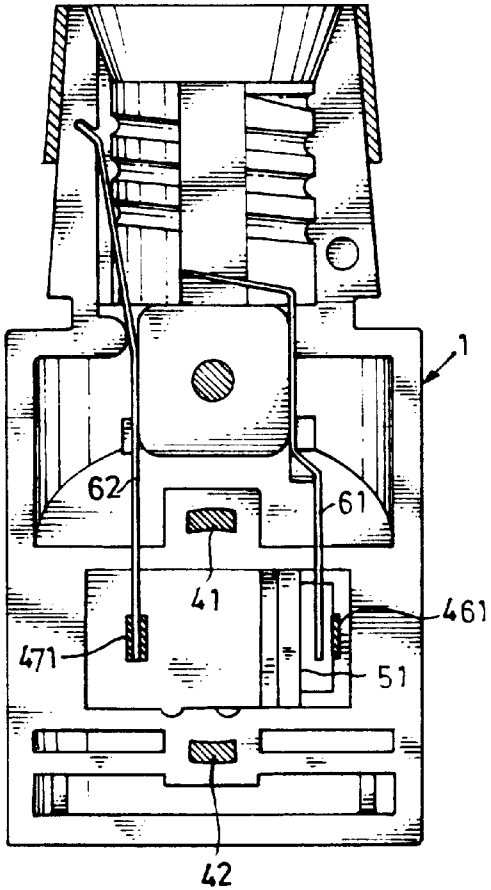
FIG. 6 is a sectional view of the present invention, showing the switch switched on, the circuit closed.
Figure 8:
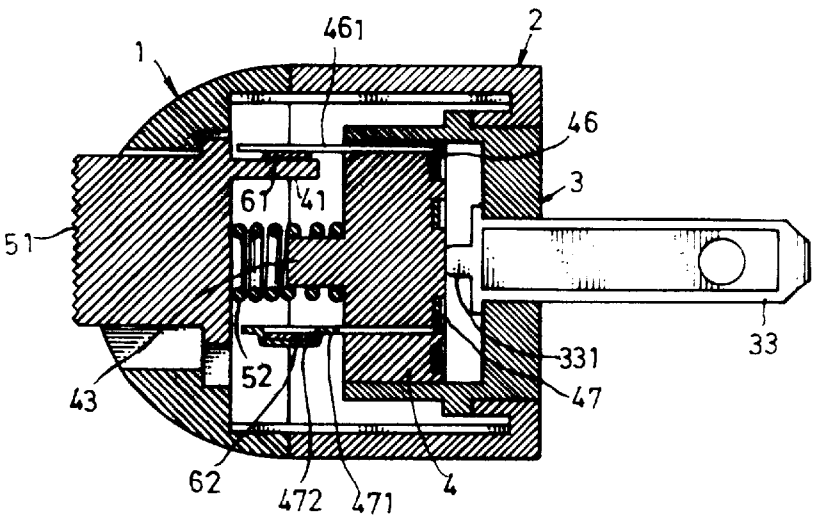
FIG. 8 is a sectional view of the present invention showing the blades vertically aligned.
Figure 7:
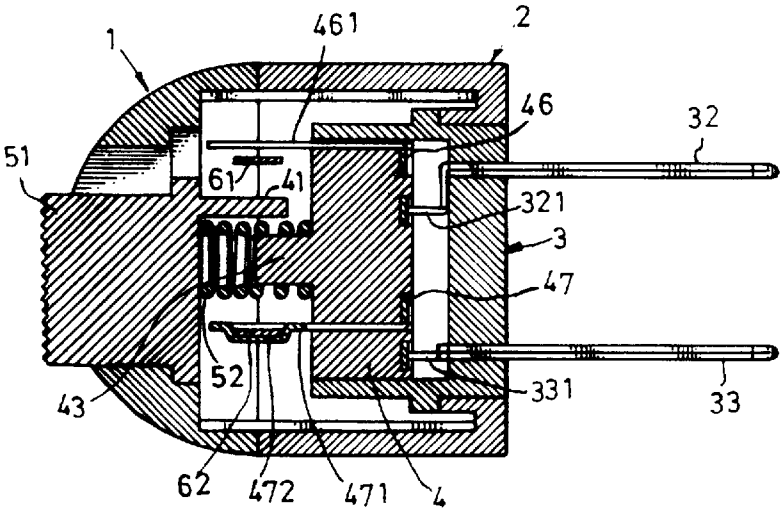
FIG. 7 is a sectional view of the present invention showing the blades horizontally aligned.

Referring to FIG. 6 and FIGS. from 3 through 5 again, the switch 51 is shifted between "ON" position and "OFF" position. When the switch 51 is shifted to "ON" position, the central terminal 61 is forced into contact with the contact strip 461 of the first annular contact 46, thereby causing the central terminal 61 and the side terminal 62 to be electrically connected, and therefore the lamp bulb is turned on (see FIG. 6). Because the first blade 33 and the second blade 32 are constantly maintained in contact with the first annular contact 46 and the second annular contact 47 when the rotary cap 3 is rotated in the through hole 21 within the second half shell 2, therefore the rotary cap 3 can be rotated to the position shown in FIG. 7 where the blades 32, 33 are horizontally aligned, or the Position shown in FIG. 8 where the blades 32, 33 are vertically aligned.

Figure 9:
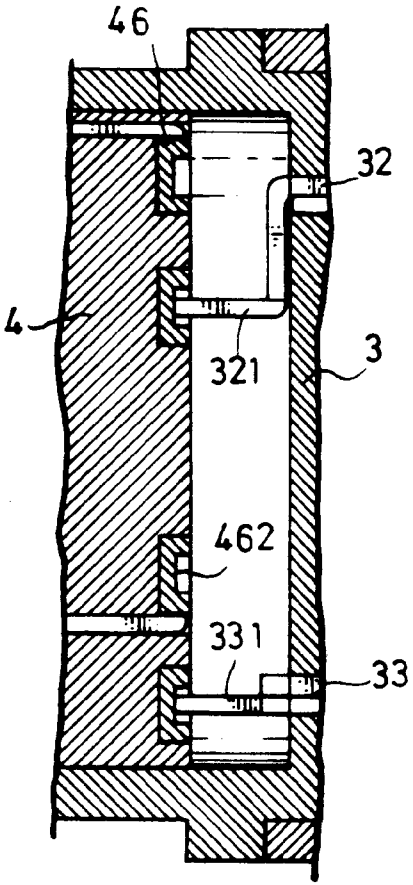
FIG. 9 is a sectional view showing an alternate arrangement of the connection between the blades and the annular contacts according to the present invention.

FIG. 9 shows an alternate form of the present invention, in which the annular contacts 46, 47 each have a peripheral groove 462, which receives the endpiece 321 or 331 of the corresponding blade 32 or 33.

Figure 10:
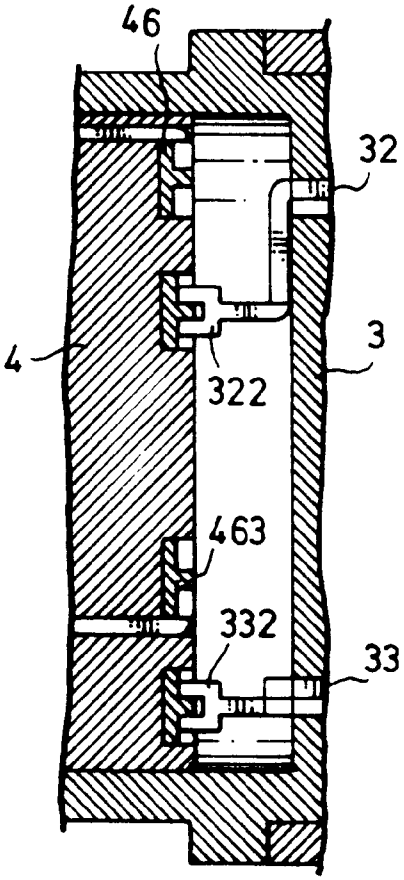
FIG. 10 is a sectional view showing another alternate arrangement of the connection between the blades and the annular contacts according to the present invention.

FIG. 10 shows another alternate form of the present invention, in which the endpiece 321 or 331 has a forked tip 322; 332, and the annular contact 46, 47 each have a peripheral track of T-shaped cross section 463, which receives the forked tip 322; 332 of the endpiece 321 or 331 of the corresponding blade 32 or 33.

I claim:

1. A mini wall lamp comprising:

a housing, said housing comprising a first half shell and a second half shell fastened together, said first half shell having a transverse hole horizontally disposed at a lower part thereof, said second half shell having a circular through hole horizontally disposed at a lower part thereof, said first half shell and second half shell having a respective upper part fastened to each other and defining a vertically extended and internally threaded lamp bulb receiving means;

a rotary cap rotatably counted in the circular through hole within said second half shell;

a circular fixed member mounted inside said housing and fixedly fastened to said first half shell, said fixed member comprising a front side wall, a rear side wall, at least one mounting rod axially extended from the back side wall and respectively fastened to a respective plug hole in said first half shell, a stub round rod raised from the center of the back side wall, an inner annular groove and an outer annular groove concentrically provided at the front side wall;

a first annular contact and a second annular contact respectively mounted in said inner annular groove and said outer annular groove at the front side wall of said fixed member, said first annular contact and said second annular contact each having a backwardly extended contact strip respectively inserted through a respective through hole on said fixed member;

a first metal blade and a second metal blade respectively mounted in said rotary cap and extended out of said second half shell for connection to an electric socket to obtain power supply from it, said first metal blade and said second metal blade each having an endpiece respectively maintained in contact with first annular contact and said second annular contact;

a central terminal and a side terminal respectively mounted inside said housing for contacting the tip contact and the ring contact of the lamp bulb being installed in said internally threaded lamp bulb receiving means of said housing, said central terminal being spaced from the contact strip of said first annular contact at a distance, said side terminal being connected to the contact strip of said second annular contact;

a switch mounted the transverse hole at said first half shell and shifted between a first position where said central terminal is forced into contact with the contact strip of said first annular contact, and a second position where said central terminal is disconnected from the contact strip of said first annular contact; and a compression spring mounted on the stub rod of said fixed member and stopped between said switch and said fixed member.

2. The mini wall lamp of claim 1 wherein said first metal blade and said second metal blade are arranged in parallel in a radial direction perpendicular to the longitudinal central axis of said lamp bulb receiving means of said housing.

3. The mini wall lamp of claim 1 wherein the contact strip of said second annular contact has a through hole to which said side terminal is fastened.

4. The mini wall lamp of claim 1 wherein said first annular contact and said second annular contact each have a peripheral groove for receiving the endpiece of the corresponding metal blade.

5. The mini wall lamp of claim 1 wherein the endpiece of each of said metal blades has a forked tip; said first annular contact and said second annular contact each have a peripheral track of T-shaped cross section, which receives the forked tip of the endpiece of the corresponding metal blade.

* * * * *

UNITED STATES PATENT AND TRADEMARK OFFICE

CERTIFICATE OF CORRECTION

PATENT NO. : 5,954,519
DATED : September 21, 1999
INVENTOR(S) : Hsu-Ting Hsiao

It is certified that error appears in the above-identified patent and that said Letters Patent is hereby corrected as shown below:

Column 3,
Line 27, change “counted” to -- mounted --.
Line 31, change “rear” to -- back -- ;

Column 4,
Line 17, insert -- in -- between “mounted” and “the transverse hole”.

Signed and Sealed this

Twenty-fifth Day of March, 2003

JAMES E. ROGAN
*Director of the United States Patent and Trademark Office*